US010731489B2

(12) United States Patent
Uecker

(10) Patent No.: US 10,731,489 B2
(45) Date of Patent: Aug. 4, 2020

(54) GUIDE VANE SEGMENT WITH CURVED RELIEF GAP

(71) Applicant: MTU Aero Engines AG, Munich (DE)

(72) Inventor: Markus Uecker, Puchheim (DE)

(73) Assignee: MTU Aero Engines AG, Munich (DE)

( * ) Notice: Subject to any disclaimer, the term of this patent is extended or adjusted under 35 U.S.C. 154(b) by 73 days.

(21) Appl. No.: 16/028,749

(22) Filed: Jul. 6, 2018

(65) Prior Publication Data

US 2019/0017397 A1 Jan. 17, 2019

(30) Foreign Application Priority Data

Jul. 11, 2017 (DE) ..... 10 2017 211 866

(51) Int. Cl.
*F01D 9/04* (2006.01)
*F01D 11/00* (2006.01)

(52) U.S. Cl.
CPC ..... *F01D 9/041* (2013.01); *F01D 11/005* (2013.01); *F05D 2220/32* (2013.01); *F05D 2240/55* (2013.01); *F05D 2240/80* (2013.01); *F05D 2260/941* (2013.01)

(58) Field of Classification Search
CPC ..... F01D 5/143; F01D 5/225; F01D 9/041; F01D 11/005; F05D 2220/32; F05D 2240/11; F05D 2240/55; F05D 2260/941
See application file for complete search history.

(56) References Cited

U.S. PATENT DOCUMENTS 3,781,125 A 12/1973 Rahaim et al.
5,071,313 A * 12/1991 Nichols ..... F01D 11/08 415/134
5,593,276 A * 1/1997 Proctor ..... F01D 11/18 415/138
7,097,422 B2 * 8/2006 Rice ..... B23H 9/10 415/134
8,511,089 B2 * 8/2013 Bastnagel ..... F23R 3/002 60/752

(Continued)

FOREIGN PATENT DOCUMENTS

DE 102015203422 A1 8/2015
DE 102015207760 A1 11/2016
FR 2929983 A1 10/2009

*Primary Examiner* — David E Sosnowski
*Assistant Examiner* — Sang K Kim
(74) *Attorney, Agent, or Firm* — Barlow, Josephs & Holmes, Ltd.

(57) ABSTRACT

The invention relates to a guide vane segment for aircraft gas turbine, which extend along a respective circular arc and together form an annular section, wherein, in the radial direction between the outer shroud and the inner shroud, a plurality of guide vanes are arranged adjacently in the peripheral direction, the outer shroud and the two sealing walls form a trough-like profile in longitudinal section, wherein, at the axially front or/and rear sealing wall element (s), at least one relief gap with a main section is provided, which extends substantially radially inward, starting from a radial outer edge of the respective front or/and rear sealing wall element(s) along the sealing wall element. According to the invention, it is proposed that the relief gap has at least one additional section that adjoins the main section radially inward, wherein the additional section is formed by at least one curved subsection.

10 Claims, 4 Drawing Sheets

(56) References Cited

U.S. PATENT DOCUMENTS

| | | | | |
|---|---|---|---|---|
| 8,721,289 | B2 * | 5/2014 | John | F01D 5/225 416/191 |
| 9,506,365 | B2 | 11/2016 | Smoke et al. | |
| 2007/0166154 | A1 * | 7/2007 | Ellis | F01D 9/041 415/211.2 |
| 2008/0304972 | A1 * | 12/2008 | Xiao | F01D 5/10 416/203 |
| 2010/0116603 | A1 * | 5/2010 | Kitchell | F16D 65/12 188/218 XL |
| 2015/0300192 | A1 | 10/2015 | Smoke et al. | |
| 2018/0010467 | A1 * | 1/2018 | Zhang | F01D 5/20 |
| 2018/0371948 | A1 * | 12/2018 | Lepretre | F01D 25/246 |

* cited by examiner

GUIDE VANE SEGMENT WITH CURVED RELIEF GAP

DESCRIPTION BACKGROUND OF THE INVENTION

The present invention relates to a guide vane segment for a gas turbine, in particular an aircraft gas turbine, comprising at least one radially outer shroud and one radially inner shroud, which extend along a respective circular arc and together form an annular section, wherein, in the radial direction between the outer shroud and the inner shroud, a plurality of guide vanes are arranged adjacently in the peripheral direction and are joined, preferably in a material-bonded manner and, in particular, in one piece, to the inner shroud and to the outer shroud, wherein, in relation to an axial longitudinal direction, the outer shroud comprises an axially front sealing wall element and an axially rear sealing wall element in such a way that the outer shroud and the two sealing walls form a trough-like profile in longitudinal section, wherein, at the axially front or/and rear sealing wall element, at least one relief gap with, for example, a substantially linearly extending main section is provided, which extends substantially radially inward, starting from a radial outer edge of the respective front or/and rear sealing wall element along the sealing wall element.

Directional terms, such as "axial" or "axially," "radial" or "radially,", and "peripheral" are fundamentally to be understood as referring to the machine axis of the gas turbine, unless something else ensues explicitly or implicitly from the context.

Relief gaps in guide vane segments of gas turbines serve, in particular, for the purpose of reducing forces in the component due to thermal expansion. It is possible in this way to protect other regions in which cracks would lead to vibrational fatigue of the entire component, in particular of an entire guide vane ring that is formed by a plurality of guide vane segments.

In the case of such relief gaps, the linear main section of which has a radially inner-lying base or gap floor, it has been found that, in the region of the base, high tensile stresses occur during operation of the gas turbine and these can lead to crack formation at the gap in question. The crack formation at such relief gaps results in a reduction in the service life of a guide vane segment or of a guide vane ring that is formed from a plurality of guide vane segments.

SUMMARY OF THE INVENTION

The object of the invention is to provide a guide vane segment for which the crack formation is reduced.

To achieve this object, it is proposed that, in a guide vane segment, the relief gap has at least one additional section that adjoins the main section radially inward, wherein the additional section is formed by at least one curved subsection.

The provision of an additional section that has at least one curved subsection leads to an improved stress distribution in the region of the relief gap having the main section and at least one curved subsection. In particular, it is possible through the provision of the additional section to avoid a base or gap floor that directly adjoins the linear main section, as a result of which the high stresses in the region of the base or gap floor are counteracted.

The relief gap can extend in the peripheral direction in its radially innermost region or/and can terminate in one end region or in a plurality of regions, which lies or lie radially further outward than a radially innermost region of the relief gap.

In an enhancement, it is proposed that the additional section has at least one curved first subsection and at least one curved second subsection, which are joined to one another. In this case, the first subsection can be curved with a first radius, and the second subsection can be curved with a second radius, wherein the first radius can be greater than the second radius. The two subsections can be joined to a third radius.

Through the provision of differently curved subsections, in particular a first subsection with a first curvature and a second subsection with a second curvature, which is different from the first curvature, the relief gap can be designed optimally in terms of the stress distribution. In this case, it is possible for forces that were hitherto concentrated in the base or gap floor to be accommodated in a distributed manner along the differently curved subsections.

The first subsection can be arranged so that, in the region of junction to the main section, it has a tangent that extends substantially orthogonal to the main section. In other words, the tangent to the main section can also be a tangent to an imaginary peripheral direction extending in an arch in the region of the junction. The first subsection can thereby be designed convexly in such a way that it extends radially outward, starting from the region of the junction to the main section. In relation to the arrangement of a guide vane segment in a gas turbine, therefore, the first subsection of the additional section of the relief gap has a radially inward convex curvature and extends substantially in the peripheral direction. In other words, it can also be stated that the first subsection forms an arched section, the chord of which extends substantially in the peripheral direction or substantially orthogonal to the radial direction.

The second subsection can be arranged so that it has a tangent that is parallel to the main section. In this case, the second subsection can be designed convexly in the peripheral direction away from the main section. In relation to the arrangement of a guide vane segment in a gas turbine, therefore, the second subsection of the additional section of the relief gap has a convex curvature that is directed away from the main section in the peripheral direction. Such a second subsection extends substantially in the radial direction. In other words, it can also be stated that the second subsection forms a section of an arc, the chord of which extends substantially in the radial direction or substantially parallel to the main section or substantially orthogonal to the peripheral direction.

It follows from the above descriptions and features that the first subsection and the second subsection can preferably be formed concavely curved in the direction of the main section.

In accordance with a first variant, the main section can be joined to the first subsection and, in particular, the main section can be joined to a middle region of the first subsection. In this case, it is possible to arrange a respective second subsection, which is joined to the first subsection, at the first subsection on sides of the main section that lie opposite in the peripheral direction. In this way, the first subsection and the two second subsections adjoining it form two hook-shaped sections that are joined to the main section. In other words, it can be stated that the relief gap forms a kind of anchor shape of the relief gap with the main section and the additional section, which has a first subsection and two second subsections.

In accordance with a second variant, the main section can be joined to a second subsection by means of a third subsection and, in particular, is joined to a radially outer end of the second subsection. In this case, it is possible for the first subsection to adjoin the second subsection joined to the main section. Furthermore, in this second variant, it is possible for another second subsection to adjoin the first subsection. Finally, it is thereby possible for the third subsection and the adjoining second subsection to be S-shaped in form. In particular, the third subsection and the second subsection transition smoothly into each other. In other words, the third subsection is arranged between the main section and the one second subsection. In the second variant, a kind of hook shape or loop shape of the relief gap is formed through the sequence of the third subsection, the second subsection, the first subsection, and the additional second subsection.

In this case, "S-shaped in form" can mean, in particular, that the sections in question together form an S shape and/or are curved in opposite directions with respect to one another.

In one or more of the above-mentioned embodiments, the relief gap can have the shape of a question mark without the dot. In this embodiment and in other embodiments, the main section can be arranged in a middle region of the relief gap in the peripheral direction—for example, within a region of 20% to 80% or also 35% to 65% of the peripheral extension. Alternatively or additionally, the relief gap can also be unbranched and/or can have only a single end within the affected front and rear sealing wall element.

In order for the force distribution or stress distribution to be optimally produced, it is possible to form a respective transition between the first subsection and the second subsection by way of a transition section, wherein, preferably, the transition section has a transition radius that is less than the first radius and less than the second radius. It is thereby possible for the transitions of the radii to occur substantially tangentially, that is, at a point at which a tangent to the two adjacent, but differently curved sections can be formed. Through such tangential transitions of the radii, it is possible to ensure that no jumps in the curvature occur along the differently curved subsections.

An end section can be assigned to at least one second subsection. In this case, it is possible for the end section to be curved with the same radius (second radius) as the second subsection. However, it is also conceivable for the end section to have a radius that is less than that of the second radius. In this case, the end section is designed such that a tangent extends at an angle to the main section and, in particular, would intersect the main section.

The invention further relates to a gas turbine, in particular an aircraft gas turbine, with at least one compressor arrangement, a combustion chamber, and at least one turbine arrangement, wherein the compressor arrangement or/and the turbine arrangement has or have at least one guide vane arrangement, which is formed by a plurality of guide vane segments that are arranged adjacently to one another in the peripheral direction in accordance with the present invention.

It is noted that the present invention also comprises embodiments in which, alternatively or additionally, a corresponding relief gap is provided in the interior of the shroud. The inner shroud can likewise (that is, just like the outer shroud) comprise, in relation to the axial longitudinal direction, an axially front sealing wall element and an axially rear sealing wall element in such a way that the inner shroud and said two sealing walls form an (inverted) trough-shaped profile in longitudinal section. In these embodiments, it is thereby possible, alternatively or additionally, (likewise) to provide radially inner relief gaps at the axially front or/and rear sealing wall element with a main section, which extends substantially radially outward, starting at a radial inner wall of the front or/and rear sealing wall element in question along the sealing wall element. These additional or alternative radially inner relief gaps can have at least one additional section adjoining the main section radially outward, which (likewise) can be formed by at least one curved subsection.

Said radially inner relief gap can be designed correspondingly or analogously to the (outer) relief gap that was previously defined and is described in more detail below on the basis of the figures; that is, it can correspond or substantially correspond to a mirror-image outer relief gap in accordance with one or more of the preceding and/or following embodiments.

BRIEF DESCRIPTION OF THE DRAWING FIGURES

The invention will be described below with reference to the appended figures by way of example and without any limitation.

DESCRIPTION OF THE INVENTION

Figure 1:
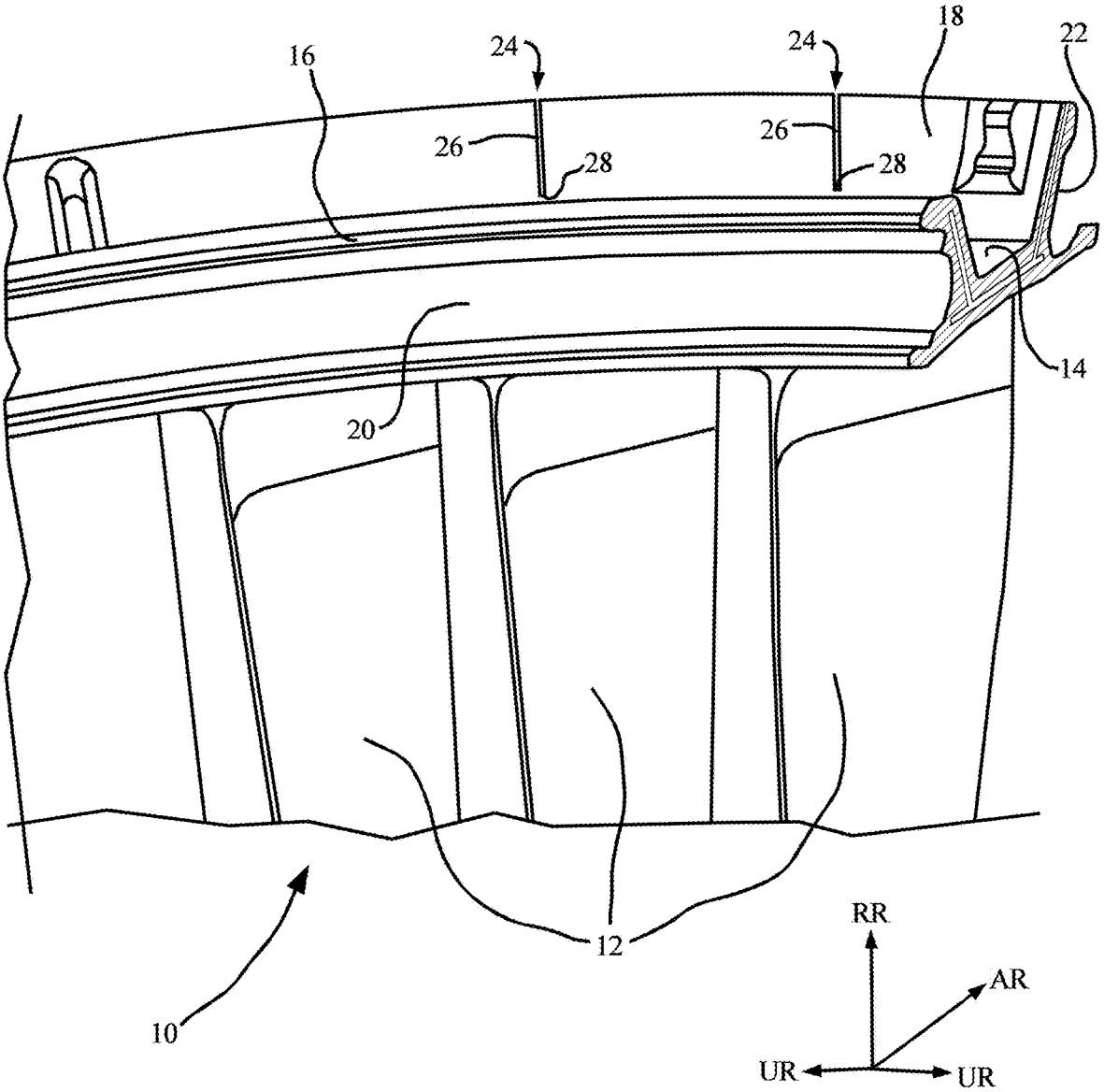
FIG. 1 shows, in a simplified and schematic perspective illustration, a guide vane segment with conventional relief gaps.

FIG. 1 shows, in a simplified and schematic perspective illustration, an excerpt of a guide vane segment 10. The guide vane segment comprises a plurality of guide vanes 12, which are arranged in the peripheral direction UR adjacently to one another. Illustrated in FIG. 1 is an outer or top shroud 14 of the guide vane segment 10 in the radial direction RR. In relation to an axial direction AR, an axially front sealing wall element 16 and an axially rear sealing wall element 18 are arranged at the shroud 14. The outer shroud 14 and the two sealing walls 16, 18 form a trough-shaped profile in longitudinal section. In an axially front region and in an axially rear region, the sides 20, 22 of the sealing walls 16, 18 that each face away from the formed trough create seats for connecting the guide vane segment 10 to other structural components of a gas turbine, which are not further illustrated.

In the rear sealing wall element 18, a plurality of relief gaps 24 are arranged along the peripheral direction. The relief gaps 24 illustrated in FIG. 1 extend substantially linearly in the radial direction RR and along the inclined sealing wall element 18.

In accordance with this known design, the relief gaps 24 have only one main section 26, which has a base 28 or gap base radially inward. As already explained in the introduction, the linearly extending relief gaps 24 are detrimental in that high stresses or tensile forces arise at the base 28, this being seen, in particular from FIG. 6, in the top stress distribution diagram and being indicated by a white arrow. Investigations in this regard have resulted in values of greater than 1000 MPa for a linear relief gap.

Figure 2:
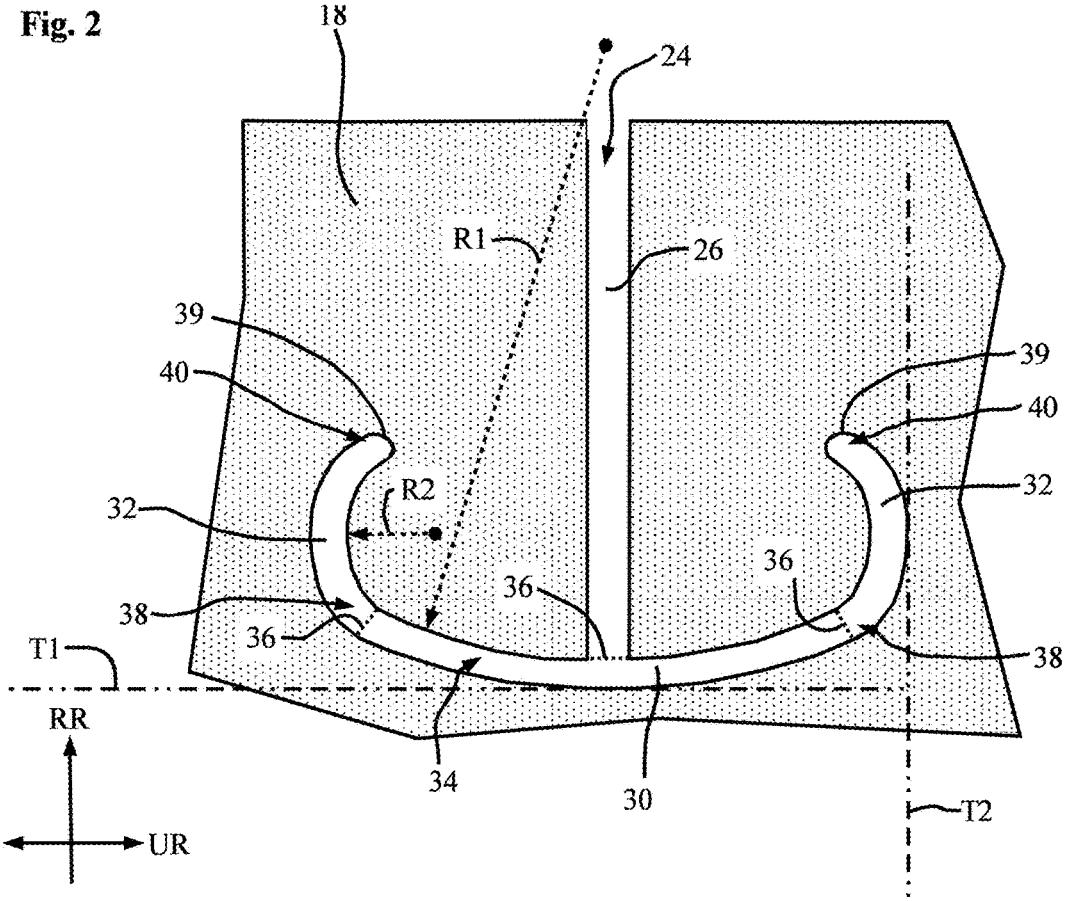
FIG. 2 shows, in a simplified and schematic plan view, a relief gap in accordance with a first embodiment.

FIG. 2 shows, in a simplified and schematic illustration, which can also be referred to as a plan view of the sealing wall element 18, a relief gap 24 in accordance with a first embodiment. The relief gap 24 comprises a main section 26. Furthermore, the relief gap 24 comprises a first subsection 30 and, in the example illustrated, two second subsections 32, which adjoin the first subsection on the left and right in the peripheral direction. The first subsection 30 and the two second subsections 32 together form an additional section 34, which, together with the main section 26, forms the entire relief gap 24. The main section 26 transitions into the first subsection 30 and, in particular, the main section 26 is joined to said first subsection in a middle region of the first subsection 30 in relation to the peripheral direction UR.

In order to highlight a possible delimitation of the subsections 30, 32, dotted lines 36 are drawn and illustrate a possible transition from the one subsection into the other subsection. However, it is noted that the lines 36, which are drawn here purely schematically, merely indicate, for instance, where a transition between subsections can be arranged in a qualitative manner.

The first subsection 30 has a radially inward convex curvature. It is thus curved concavely with respect to the main section 26. The curvature is formed by a first radius R1, which, for illustration, is drawn in FIG. 2 as a dashed line. If the two lines 36, which indicate the extension of the first subsection 30 in the peripheral direction, are regarded, it can also be stated that the first subsection 30 extends substantially in the peripheral direction UR. At least it extends transversely to the radial direction RR or to the main section 26. In other words, it can be stated that the first subsection 30 is arranged or is curved in such a way that it has a tangent T1, which is directed orthogonal to the radial direction RR.

The second subsection 32 has a convex curvature away from the main section 26 in the peripheral direction. The curvature is formed by a second radius R2, which is drawn in FIG. 2 as a dashed line for illustration. The second subsection 32 extends substantially in the radial direction RR. At least it extends in part crosswise to the peripheral direction UR. In other words, it can be stated that the second subsection 32 is arranged such that it has a tangent T2, which is directed parallel to the radial direction or parallel to the main section 26.

The first radius R1 is greater than the second radius R2. In a region of the respective lines 36 or the transitions between two subsections 30, 32, a transition section 38 can be provided. Such a transition section can be curved with a third radius, which is smaller than the first radius R1 and the second radius R2.

The course of curvature of the additional section 34 with different radii of the subsections 30, 32, which is illustrated in a purely schematic and simplified manner, is in reality preferably designed such that, along changing curvatures, no jumps or steps result. The transitions of the radii between two adjacent subsections or transition sections 30, 32, 38 occur tangentially.

The free ends 39 of the second subsections 32 can also be formed by terminating sections 40, which are not illustrated here in more detail. Such terminating sections 40 have a fourth curvature, which is less than the second radius R2. The second subsections 32 or the free ends 39 thereof can be directed toward the main section 26. The relief gap 24 illustrated in FIG. 2 has a kind of double hook shape or anchor shape.

Figure 3:
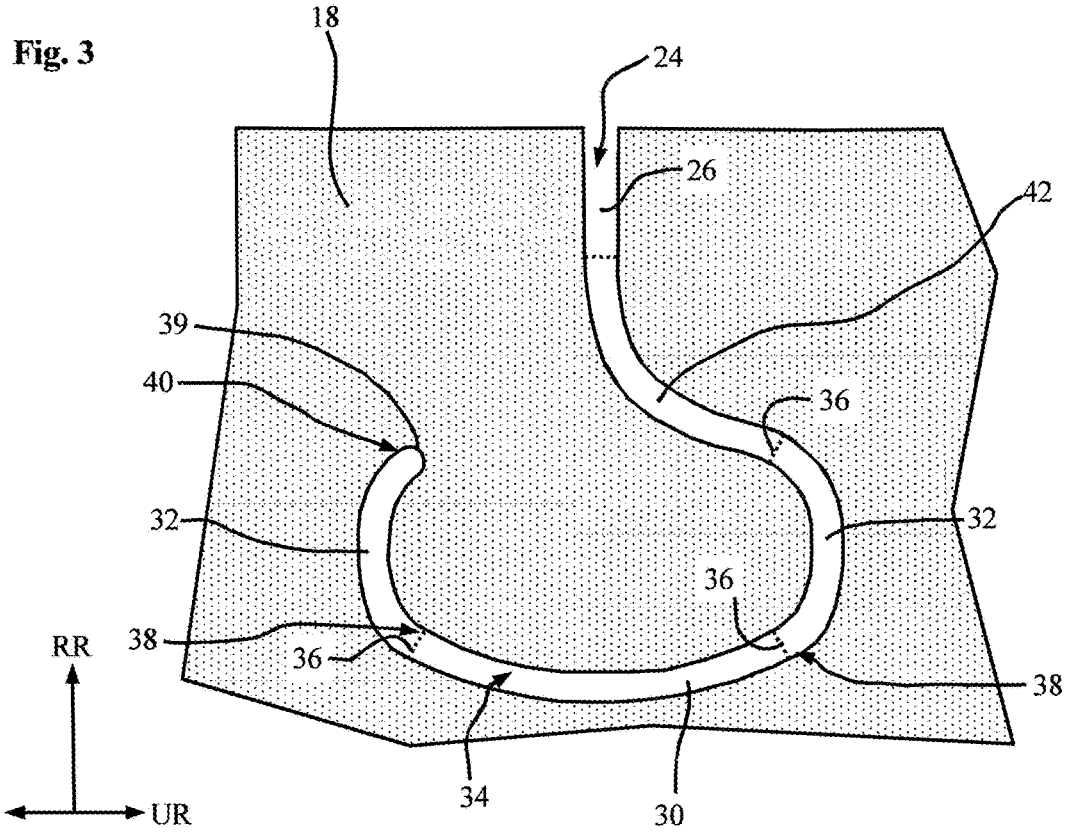
FIG. 3 shows, in a simplified and schematic plan view, a relief gap in accordance with a second embodiment.

FIG. 3 shows a second embodiment of a relief gap 24 with the main section 26, a first subsection 30, and two second subsections 32. In contrast to the exemplary embodiment of FIG. 2, the main section 26 is joined to the right second subsection 32 in the peripheral direction UR by means of a third subsection 42. The third subsection 42 forms a curvature that is counter to that of the adjoining second subsection 32. These two subsections 32, 42 form a kind of S-shaped connection between the main section 26 and the first subsection 30. In regard to the radii with which the first subsection 30 or the second subsection 32 are curved, the same essentially holds true as described in regard to the embodiment of FIG. 2. It is clear that, also at the transition between the third subsection 42 and the second subsection 32 adjoining it, a transition section can be provided in the region of the line 36. The same holds true, of course, also for the other transitions 38 between the second subsections 32 and the first subsection 30 for the lines 36, as has already been described above in reference to FIG. 2.

The relief gap 24 in accordance with FIG. 3 has a single free end 39 at the left second subsection. This end 39, too, can be formed by a terminating section 40, as has already been described in reference to FIG. 2. Overall, what results for the relief gap 24 in accordance with FIG. 3 is a kind of hook shape or loop shape.

Figure 4:
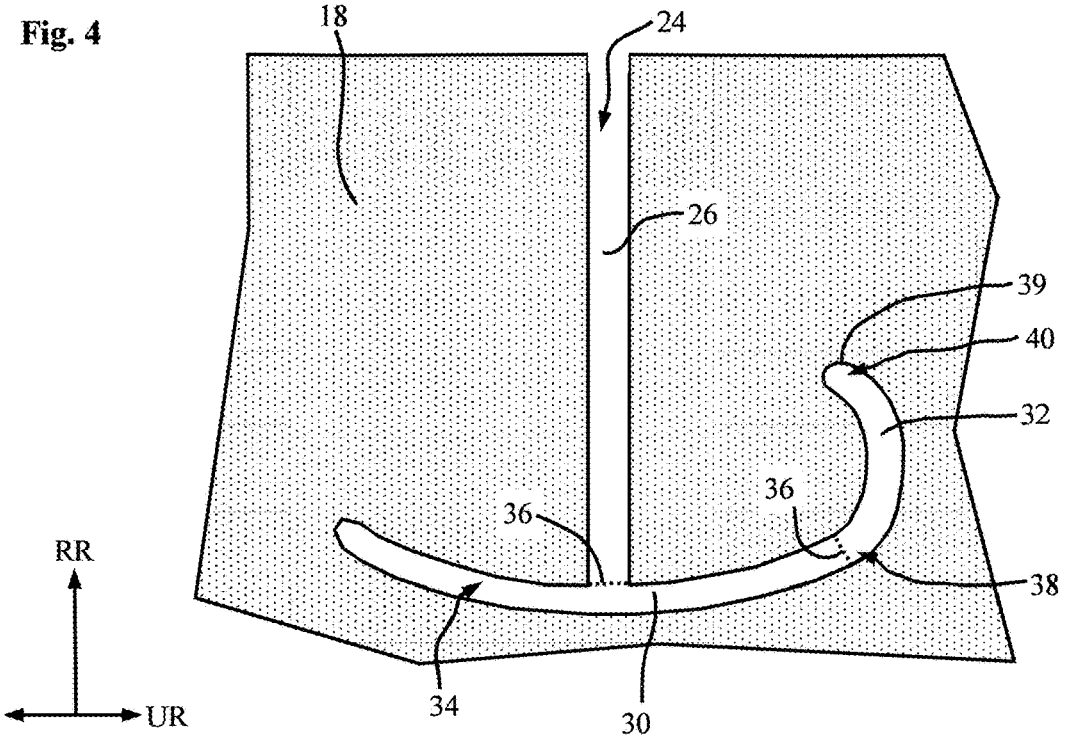
FIG. 4 shows a modification of the embodiment in accordance with FIG. 2.

FIG. 4 shows a modification of the relief gap 24 in accordance with FIG. 2. It has been found that the relief gap need not necessarily have two second subsections 32. Instead, it is possible for a second subsection 32 to be provided at the first subsection 30 only on one side. Whether the second subsection 32 in such an embodiment is arranged on the left in relation to the peripheral direction UR, as illustrated in FIG. 4, or on the right at the first subsection 30 can be chosen at will. In regard to the dimensions of the curvature radii, the same essentially holds true as for the embodiment in accordance with FIG. 2 and also likewise for transition regions between the subsections 30, 32.

Figure 5:
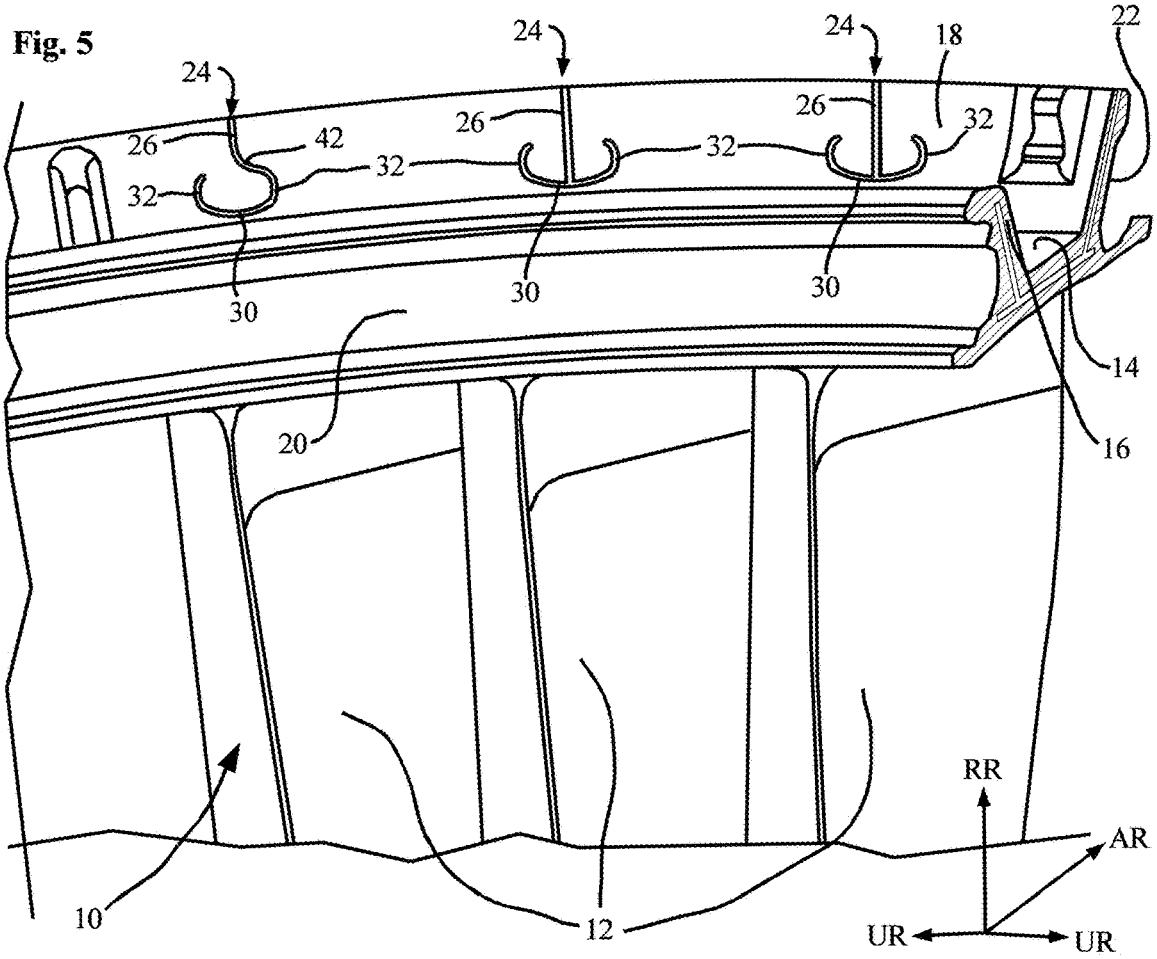
FIG. 5 shows, by way of example, the guide vane segment of FIG. 1 with relief gaps in accordance with the two embodiments of FIGS. 2 and 3.

FIG. 5 shows, purely for illustration, the guide vane segment 10 of FIG. 1, with relief gaps 24 in accordance with FIG. 2 and FIG. 3 being drawn in a simplified and purely illustrative manner. This illustration serves merely for showing the arrangement of such relief gaps with curved subsections 30, 32. The specific number of relief gaps 24 at a guide vane segment 10 can be chosen at will. Usually, for a guide vane segment 10, a plurality of similar or only similar relief gaps 24 are provided. Therefore, a mixture of relief gaps, as are illustrated in FIG. 5, does not correspond, as a rule, to an actual embodiment, but serves here instead solely for illustration.

Figure 6A:
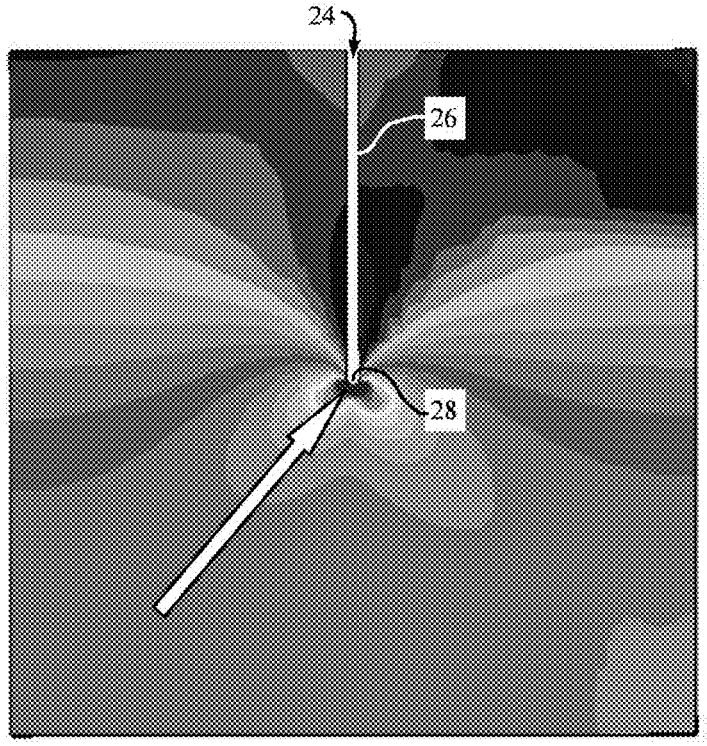
FIGS. 6A and 6B show, respectively, in a simplified and qualitative manner, stress distributions for a conventional relief gap and for a relief gap in accordance with the first embodiment.
Figure 6B:
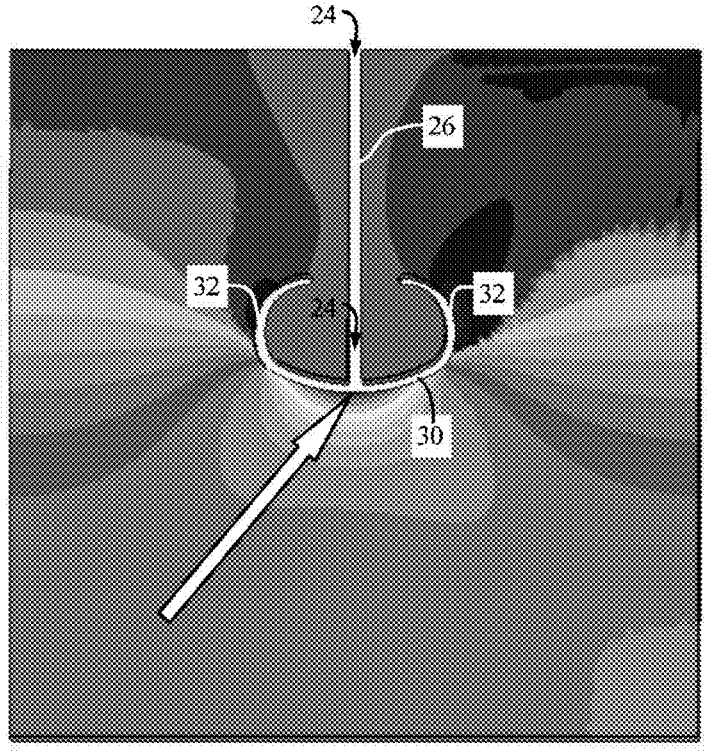

Finally, reference is made to FIG. 6A, the top stress image of which has already been described above in the introductory part of the description of the figures. The bottom image of FIG. 6B shows a typical stress distribution for a relief gap 24 in accordance with an embodiment such as is illustrated in FIG. 2 and has been explained above. It has been found that, in the region of the transition of the main section 26 to the first subsection 30, a markedly reduced stress occurs owing to the design of the relief gap with the curved subsections 30, 32. In particular, it has been found that the stresses in the region of interest at the radially inner end of the main section 26 lie below 500 MPa.

If the stresses occurring for a conventional relief gap (top diagram) are compared with those of a relief gap in accordance with the present invention, the applicant has been able to establish in tests that the stresses in the region of interest (white arrow) could be reduced by about fourfold. Furthermore, it has also been found that, at the free ends 39 of the second subsections 32, there occur no stresses for which a high risk of crack formation would exist.

In conclusion, it is additionally noted that the relief gaps 24 in accordance with the examples illustrated here (FIGS. 2-4) can allow the passage of somewhat more fluid or gas than the conventional linear relief gaps on account of their overall greater total length or total extension. However, this effect can be counteracted through a narrower design of the curved relief gaps. In this way, the surfaces through which a flow can freely occur is further reduced.

Overall, what results through the presented design of relief gaps with curved subsections is the possibility of providing guide vane segments that have an improved or prolonged service life, without it being necessary in this case to take into account substantial losses in the sealing effect.

In a gas turbine, which is not illustrated here, and, in particular, in an aircraft gas turbine, it is possible to form a guide vane ring through a plurality of the above-described guide vane segments 10, which are arranged adjacently in the peripheral direction. Such a guide vane ring can thereby be assigned to a compressor side or a turbine side of the gas turbine.

What is claimed is:

1. A guide vane segment for an aircraft gas turbine, comprising at least one radially outer shroud and one radially inner shroud, which extend along a respective circular arc and together form an annular section, wherein, in the radial direction between the outer shroud and the inner shroud, a plurality of guide vanes are arranged adjacently in the peripheral direction, which are joined, in a material-bonded manner and in one piece, to the inner shroud and to the outer shroud, wherein, in relation to an axial longitudinal direction, the outer shroud comprises an axially front sealing wall element and an axially rear sealing wall element configured so that the outer shroud and the two sealing walls form a trough-like profile in longitudinal section, wherein, at the axially front or/and rear sealing wall elements, at least one relief gap with a main section is provided, which extends substantially radially inward, starting from a radial outer edge of the respective front or/and rear sealing wall elements along the sealing wall element, wherein the relief gap has at least one additional section that adjoins the main section radially inward, wherein the additional section is formed by at least one curved subsection, wherein the main section is joined to a second subsection by a third subsection and is joined to a radially outer end of the second subsection and the at least one additional section adjoins the third subsection, and wherein the third subsection and the adjoining second subsection are S-shaped in configuration.

2. The guide vane segment according to claim 1, wherein the relief gap extends in the peripheral direction in its radially innermost region or/and terminates in one end region or a plurality of end regions, which lies or lie further radially outward than a radially innermost region of the relief gap.

3. The guide vane segment according to claim 2, wherein the additional section has at least one curved first subsection and the second subsection is at least one curved second subsection, which are joined to one another, or/and in that the first subsection is curved with a first radius, and in that the second subsection is curved with a second radius, wherein the first radius is greater than the second radius.

4. The guide vane segment according to claim 3, wherein the first subsection is configured and arranged convexly so that it extends radially inward, starting from a region of the junction to the second subsection.

5. The guide vane segment according to claim 3, wherein the second subsection is configured and arranged such that it has a tangent that runs parallel to the main section.

6. The guide vane segment according to claim 3, wherein the second subsection is convexly designed in the peripheral direction away from the main section.

7. The guide vane segment according to claim 1, wherein a first subsection is adjoined at the second subsection, which is joined to the third subsection.

8. The guide vane segment according to claim 1, wherein the relief gap has the shape of a question mark without the dot and the main section is arranged in a middle region of the relief gap in the peripheral direction.

9. The guide vane segment according to claim 3, wherein a respective transition is formed between the first subsection and the second subsection through a transition section, wherein the transition section has a transition radius that is less than the first radius and less than the second radius.

10. The guide vane segment according to claim 1, wherein a plurality of guide vane segments are arranged adjacently in the peripheral direction to each other in a compressor arrangement and/or a turbine arrangement in of a gas turbine.

* * * * *